United States Patent [19]

Brown et al.

[11] 4,042,815

[45] Aug. 16, 1977

[54] ELECTRONIC MULTIPLIERS

[75] Inventors: Kenneth Robson Brown, Beamish; Colin Keith Sharp, Edinburgh, both of Scotland

[73] Assignee: Ferranti Limited, Lancashire, England

[21] Appl. No.: 649,838

[22] Filed: Jan. 16, 1976

Related U.S. Application Data

[62] Division of Ser. No. 507,422, Sept. 19, 1974, Pat. No. 3,963,912.

[30] Foreign Application Priority Data

Sept. 22, 1973 United Kingdom ..... 44550/73

[51] Int. Cl.[2] ..... G06G 7/16

[52] U.S. Cl. ..... 235/194; 307/229; 328/160

[58] Field of Search ..... 235/194, 193, 195, 196, 235/179; 328/160, 161, 165; 307/229; 321/15

[56] References Cited

U.S. PATENT DOCUMENTS

| | | | |
|---|---|---|---|
| 3,070,309 | 12/1962 | Fluegel | 235/194 |
| 3,294,961 | 12/1966 | Hose | 235/194 X |
| 3,414,721 | 12/1968 | Oliver | 235/179 X |
| 3,439,270 | 4/1969 | Rehm | 235/194 X |
| 3,448,297 | 6/1969 | Rhodes | 328/160 X |
| 3,631,262 | 12/1971 | Jarrett | 328/160 X |

*Primary Examiner*—Joseph F. Ruggiero

*Attorney, Agent, or Firm*—Cameron, Kerkam, Sutton, Stowell & Stowell

[57] ABSTRACT

A multiplier circuit arrangement comprises two parallel paths for the same signal, one of the paths being associated with signal level adjusting means; and means responsive to inbalance of d.c. components including any in said parallel paths, the inbalance being in accordance with a d.c. signal in a third signal path, to produce a control signal for varying the signal level adjusting means to reduce the imbalance, so that a.c. components in said parallel paths will be unbalanced to an extent proportional to the d.c. signal in said third path.

11 Claims, 1 Drawing Figure

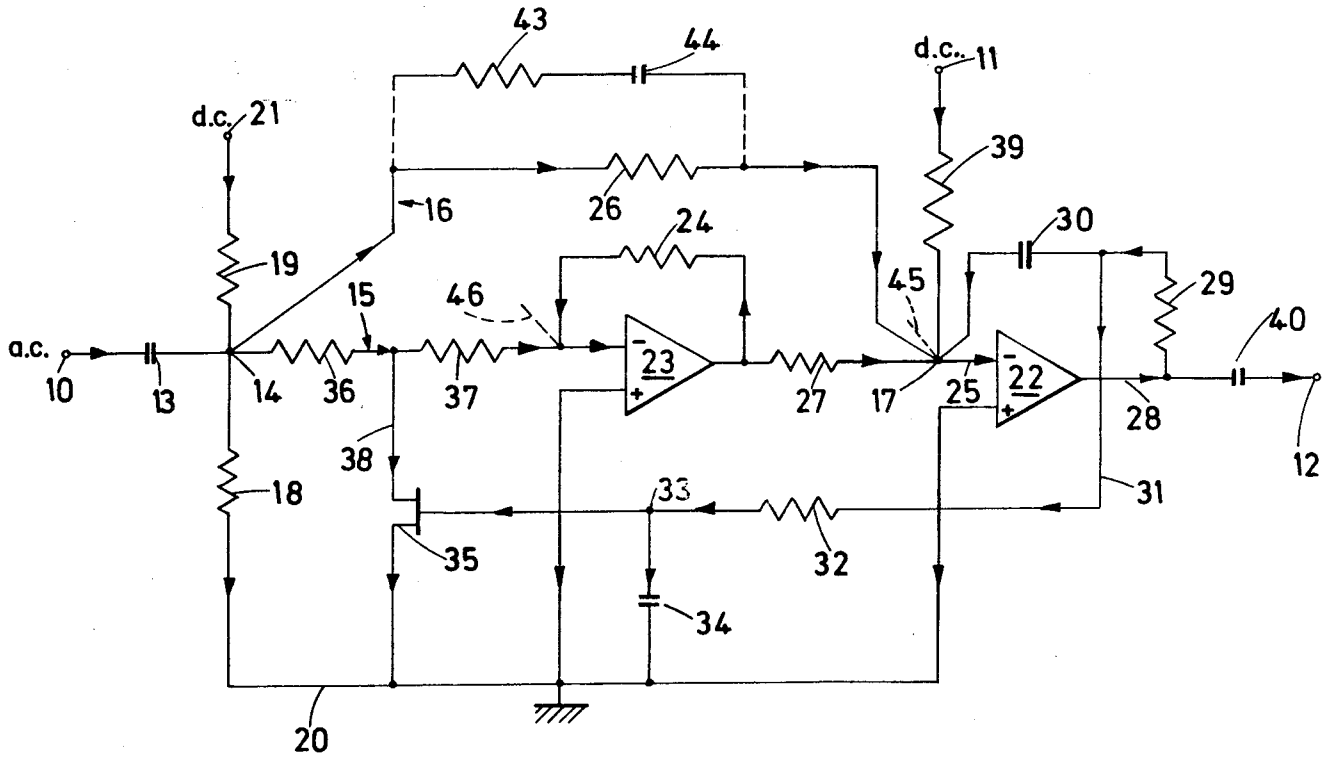
a.c.
10
13
d.c.
21
19
14
18
36
15
38
20
16
37
46
35
43
26
24
23
33
34
44
27
32
17
45
25
22
39
d.c.
11
30
31
28
29
40
12

ELECTRONIC MULTIPLIERS

This is a division of application Ser. No. 507,422, filed Sept. 19, 1974, now U.S. Pat. No. 3,963,912.

This invention relates to electronic multipliers, and has application both to a particular type of multiplier for producing an output representing the product of a d.c. signal and a.c. signal.

The particular type of multiplier circuit concerned may be used as a modulator for impressing information represented by the amplitude of a d.c. signal on to an a.c. signal of desired frequency, say a carrier for transmission purposes. Alternatively, such a circuit can be used to multiply together two different parameters with their values represented, at any time one by an a.c. signal and the other by a d.c. signal, with the a.c. signal preferably representing the corresponding parameter by its amplitude.

According to one aspect of the invention there is provided a multiplier circuit arrangement comprising two parallel paths for the same signal, one of the paths being associated with signal level adjusting means; and means responsive to imbalance of d.c. components including any in said parallel paths, said imbalance being in accordance with a d.c. signal in a third signal path, to produce a control signal for varying said signal level adjusting means to reduce said imbalance, so that a.c. components in said parallel paths will be unbalanced to an extent proportional to the d.c. signal in said third path.

Preferably, the signal level adjusting means includes a branch from said one path via variably resistive means, advantageously a field-effect transistor with its gate responsive to said control signal.

Such a circuit can be used to provide, from a junction of at least the parallel paths, an a.c. output representative of the product of an a.c. input signal applied to the parallel paths and a d.c. input signal supplied to the third path. Clearly this is equivalent to amplitude modulation of the a.c. input signal in accordance with the d.c. input signal.

It is convenient to connect the third path directly to the junction at which the a.c. output is taken from the parallel paths. Preferably, the a.c. output is taken via the means responsive, which may comprise a summing amplifier having an a.c. feedback path to a virtual earth input for the above-mentioned junction of the parallel paths. If at least one other path is also connected to the junction for application of a further d.c. input signal, the circuit output will represent a product involving the sum of the d.c. input signals.

Alternatively, the further d.c. input signal may be applied directly to influence the d.c. component in said one of the parallel paths. Conveniently, this other path includes signal inverting means and the third path is connected to the input of the signal inverting means, so that the a.c. output of the circuit will be of opposite sign compared with its first-mentioned application at the input of the means responsive. If d.c. input signals are made to both the input of such signal inverting means and the input of the means responsive, the a.c. output of the circuit will represent a product involving the difference between the d.c. input signals.

One embodiment of the invention will now be specifically described, by way of example, with reference to the accompanying drawing which shows a circuit diagram of a multiplier circuit.

A multiplier circuit is shown having a terminal 10 for application of an a.c. input signal, a terminal 11 for application of a d.c. input signal, and a terminal 12 for an output signal representative of the product of the input signals applied at terminals 10 and 11.

The a.c. input terminal 10 is coupled via capacitor 13 to one common point 14 of two parallel circuit paths 15 and 16 extending to a junction point 17 at their other ends. A potential divider comprises resistors 18 and 19 connected between a ground rail 20 and a terminal 21, and serves to supply a predetermined d.c. voltage to the common point 14. Means 22 is provided for responding to imbalance of d.c. signal components at the junction point 17 by producing a corresponding output signal. An inverting amplifier 23 with feedback via resistor 24 to its virtual earth input is provided in the parallel circuit path 15. The means 22 conveniently comprises a summing amplifier having one input 25 connected to the junction point 17 and representing a virtual earth. Any imbalance in current flow in the other parallel path via resistor 26 compared with that in the output of the inverter 23 via resistor it will give a nett input signal to the amplifier 22, which is shown connected with an a.c. feedback path from its output 28 via a resistor 29 and a capacitor 30 to its input 25. The amplifiers 22 and 23 conveniently comprise commercially available integrated circuits often referred to as operational amplifiers.

Any output signals resulting from a nett d.c. signal at the junction point 17 is used to control signal level adjusting means associated with the parallel path 15 and operative to vary the d.c. component therein in order to balance d.c. components through resistors 26 and 27. This signal level adjusting means is operative on the input to the inverter 23. The control signal on amplifier output 28 is taken over path 31 from the resistor 29, via another resistor 32 and junction 33 between that resistor and a capacitor 34 connected to the earth rail 20, and used to control the conductivity of a field effect transistor 35 preferably of the insulated gate type. This field effect transistor 35 is the variable element of the signal level adjusting means which is shown as a resistive T-network having resistors 36 and 37 in series directly in the path 15 and a branch path 38 from their mid-point to the earth rail 20 via the source-drain circuit of the field effect transistor 35 the gate of which is controlled by the amplifier output 28.

In this specific embodiment an *n*-channel field effect transistor is assumed so that a negative polarity of the control signal causes the source-drain resistance to increase. Then, less of the d.c. component in path 15 from the point 14 will pass down the branch path 38 and more of this component will be applied to the input of the inverting amplifier 23. Assuming a positive d.c. potential to be applied at the terminal 21, the output of the amplifier 23 will go more negative and the input virtual earth will be maintained by the feedback path including resistor 24. This will allow for compensating an imbalance resulting in a nett positive d.c. signal at the junction point 17. The summing amplifier 22 thus also needs to be inverting.

In the absence of a.c. and d.c. input signals at terminals 10 and 11 the circuit adjusts the level of conduction of the field effect transistor 35 so that all of the d.c. current that reaches the junction 17 via the parallel path 16 over resistor 26 is then taken over resistor 27 in the parallel path 15. The parallel paths 15 and 16 are thus in balance at the junction point 17 for d.c. signals applied at the common point 14 and there will be no nett input to the amplifier 22 whicb will have a constant level.

If an a.c. input signal is now applied to the terminal 10, and via capacitor 13 to the point 14, equal a.c. signals of opposite phase will flow in the resistors 26 and 27, and again there will be no output from the amplifier 22. The terminal 11 for a d.c. input signal is shown connected to the junction point 17 over a resistor 39. If a d.c. input is presented, the balance of d.c. components at the junction point 17 will be upset, and an output signal will appear on line 31 that has a d.c. component dependent on the input d.c. signal at the terminal 11. This will cause immediate adjustment of the conductivity of the field effect transistor 35 to alter the d.c. current flow over resistor 27 to produce balance at the junction point 17 that is virtual earthed by the amplifier 22.

The alteration of resistance of the transistor 35 can be viewed as causing a change in overall gain in the parallel path 15 resulting in the anti-phase a.c. components in the two paths 15 and 16 no longer being of equal amplitude, and thus not in cancelling relation to each other at the junction point 17. A nett a.c. signal will therefore be applied to the input 25 of amplifier 22 to produce a corresponding a.c. output which will be coupled to the output terminal 12 via a capacitor 40. Clearly, the capacitor 30 will also need to by-pass the a.c. signal frequencies in output 28. The a.c. output signal at the terminal 12 will have an amplitude dependent on the value of the d.c. input signal at the terminal 11 and so will represent product modulation of the a.c. input signal at terminal 10.

If there is sufficient difference in the resistance of the transistor 35 for d.c. and a.c. signals to undesirably affect operation of the circuit, compensation is conveniently made in the reference one, 16, of the parallel paths. This is indicated by the dotted line connection from both sides of the resistor 26 to a series combination of a resistor 43 and a capacitor 44. The capacitor 44 ensures that the resistor 43 is effective only for components of the a.c. input signal from terminal 11. Other, d.c., components at the common point 14 will see only the resistor 26 in the path 16.

If a further d.c. input is made to the junction point 17, over another resistor 39, the output 12 of the circuit will represent a product involving the sum of that further d.c. input and the one applied to terminal 11. A dashed connection branch 45 is shown to indicate this possibility. Alternatively, of course, both d.c. inputs may be applied additively via the same terminal 11, but the provision of separate input terminals may be more convenient in some applications e.g. to give a general purpose device.

Due to the presence of the inverter 23 in the circuit path 15, a change of sign of the output relative to the d.c. input signal can be obtained if a connection is used to the input of the inverting amplifier instead of via the resistor 39 to the junction point 17. Provision for such connection is indicated by the dashed circuit branch 46. If such a branch 46 is used at the same time as a branch 39 or 45 but for a different d.c. input signal, the circuit will produce an output signal representing a product involving the difference between the two d.c. input signals.

Also, if additional a.c. signal components are applied to a multiplier at the input to the summing amplifier 22, a composite a.c. signal will result representing addition of that component to the previous output of the multiplier. This facility is useful if combining components resolved from one set of axes into another set of axes.

What we claim is:

1. An electronic multiplier circuit comprising a first input terminal to which an a.c. signal is applied, a junction point, two parallel paths connected between the input terminal and the junction point, signal level adjusting means included in one of said parallel paths, a second input terminal to which a d.c. signal is applied, a third path connected to said second input terminal, an output terminal, and control means connected between the junction point and the output terminal and responsive to any imbalance of d.c. components in said parallel paths and to a d.c. signal in the third path to produce a control signal for varying the signal level adjusting means so as to reduce said d.c. imbalance, whereby a.c. components in said two parallel paths are unbalanced to an extent proportional to the d.c. signal applied to the second input terminal.

2. A circuit according to claim 1, wherein the third path is also connected to the junction.

3. A circuit according to claim 2, comprising at least one further path connected to said junction for a further d.c. input signal to produce a product involving the sum of the d.c. inputs.

4. A circuit according to claim 1, wherein the third path is connected to directly affect the a.c. signal level in the one path.

5. A circuit according to claim 1, wherein the one path includes signal inverting means.

6. A circuit according to claim 5, wherein the third path is input to the signal inverting means.

7. A circuit according to claim 6, comprising a further path connected to the junction for a further d.c. input signal to produce a product involving the difference between the d.c. inputs.

8. A circuit according to claim 1, wherein the means responsive to imbalance passes an a.c. component proportional to said imbalance.

9. A circuit according to claim 8, wherein said means responsive to imbalance comprises a summing amplifier having an a.c. feedback path to a virtual earth input to which said parallel paths are also jointly connected.

10. A circuit according to claim 1, wherein the signal level adjusting means comprises a field effect transistor having the control signal applied to its gate electrode.

11. A circuit according to claim 1, wherein the other of the parallel paths has an a.c. shunt for adjusting the path resistance in accordance with differences of resistance presented by the signal level adjusting means to a.c. and d.c. signals.

* * * * *